US010562079B2

(12) United States Patent
Yang et al.

(10) Patent No.: US 10,562,079 B2
(45) Date of Patent: Feb. 18, 2020

(54) SUPERCRITICAL-STATE CLEANING SYSTEM AND METHODS

(71) Applicant: Shanghai Yibai Industrial Furnaces Co., Ltd., Shanghai (CN)

(72) Inventors: Fan Yang, Shanghai (CN); Jingfeng Yang, Dafeng (CN)

(73) Assignee: Shanghai Yibai Industrial Furnaces Co., Ltd., Shanghai (CN)

( * ) Notice: Subject to any disclaimer, the term of this patent is extended or adjusted under 35 U.S.C. 154(b) by 77 days.

(21) Appl. No.: 15/858,991

(22) Filed: Dec. 29, 2017

(65) Prior Publication Data

US 2018/0185890 A1 Jul. 5, 2018

(30) Foreign Application Priority Data

Dec. 30, 2016 (CN) ..... 2016 1 1254190

(51) Int. Cl.
*B08B 3/08* (2006.01)
*B08B 7/00* (2006.01)

(52) U.S. Cl.
CPC ..... *B08B 7/0021* (2013.01); *B08B 3/08* (2013.01); *B08B 2220/00* (2013.01)

(58) Field of Classification Search
CPC ..... B08B 3/08; B08B 7/0021; B08B 2220/00
USPC ..... 134/104.2
See application file for complete search history.

(56) References Cited

U.S. PATENT DOCUMENTS

2008/0264443 A1* 10/2008 Shrinivasan ..... B08B 7/0021 134/2

FOREIGN PATENT DOCUMENTS

CN 101740337 A 6/2010

* cited by examiner

*Primary Examiner* — Levon J Shahinian
(74) *Attorney, Agent, or Firm* — Muncy, Geissler, Olds & Lowe, P.C.

(57) ABSTRACT

Disclosed is a supercritical-state cleaning system, comprising a cleaning chamber (4), a gas booster apparatus (11), a first heating apparatus (5), and a carbon dioxide supply apparatus. The cleaning chamber (4) is separately connected to the first heating apparatus (5) and the carbon dioxide supply apparatus. A vacuum pump set (1) is connected to the cleaning chamber (4). Compared with the prior art, in the Invention, air introduced when a workpiece enters a cleaning chamber is completely removed, so as to prevent mixing of $CO_2$ and air, thereby improving a cleaning effect.

6 Claims, 1 Drawing Sheet

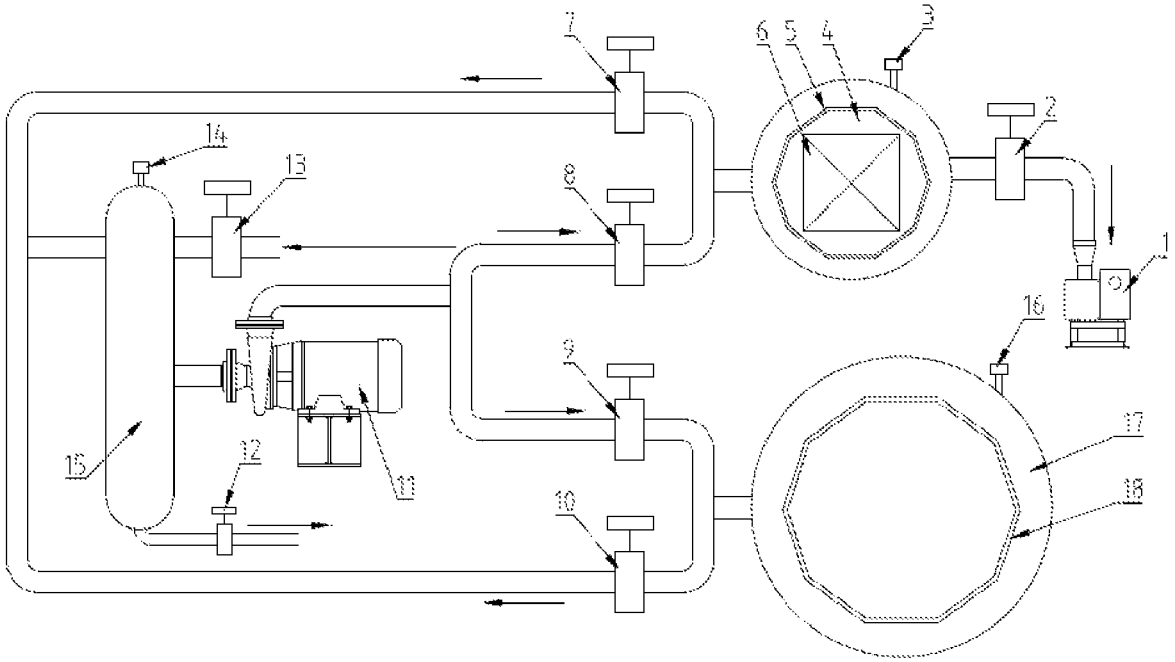
7
6
5
4
3
2
14
13
8
1
16
9
17
15
12
11
18
10

SUPERCRITICAL-STATE CLEANING SYSTEM AND METHODS

FIELD OF THE INVENTION

The Invention relates to a cleaning apparatus for a heat treatment equipment product, and in particular, to a supercritical-state cleaning system and methods.

BACKGROUND OF THE INVENTION

Commercially available cleaning equipment in the heat treatment industry is generally water-based cleaning machines, and only a few are hydrocarbon-solvent cleaning machines.

With respect to water-based cleaning machines, water is used as a cleaning medium. Oil cannot dissolve in water, but water-based cleaning machines are mostly used to clean workpieces after oil quenching. Therefore, to improve a cleaning effect, it is necessary to adjust the temperature of water and add a cleaning agent (or a rust inhibitor) to the water.

A major defect of a water-based cleaning machine is water pollution. The reason is that after the cleaning machine works a long time, water contains emulsified oil, and therefore a cleaning effect is severely affected. Therefore, water needs to be replaced regularly. Waste oil (quenching oil) after cleaning needs to be treated by qualified treatment units and cannot be recycled and reused. As a result, use costs are greatly increased. In addition, the cleanliness of a workpiece cleaned by using a water-based cleaning machine may fail to satisfy a requirement, as blind holes or tiny gaps of some workpieces basically cannot be cleaned. Consequently, water-based cleaning machines are not applicable to those industries having high cleanliness requirements.

With respect to hydrocarbon-solvent cleaning machines, a hydrocarbon solvent is used as a cleaning medium. The hydrocarbon solvent is a petroleum hydrocarbon mixture and can dissolve quenching oil, so that a cleaning effect is very desirable and a cleaned workpiece has a very clean surface. As the hydrocarbon solvent has a low flash point, a heating manner is used to remove the hydrocarbon solvent through distillation, and the quenching oil that remains can still be recycled and reused.

A hydrocarbon-solvent cleaning machine has a desirable cleaning effect and does not produce pollution. However, the hydrocarbon solvent is a flammable and explosive substance. Therefore, a user needs to have protection to during use and a better option is required.

Chinese Patent Application No. 200810226688X discloses a supercritical-carbon-dioxide purging and cleaning machine for semiconductors, comprising a cleaning chamber and a separation chamber. The cleaning chamber and the separation chamber are connected through a sealed carbon dioxide outlet pipe. A nozzle is provided on the cleaning chamber. Carbon dioxide is directly sprayed through the nozzle to a silicon wafer to be cleaned at the bottom of the cleaning chamber. However, air may enter the cleaning chamber during cleaning, which adversely affects a cleaning effect.

SUMMARY OF THE INVENTION

The objective of the Invention is to provide a supercritical-state cleaning system and methods that are safe and pollution-free, have a desirable cleaning effect, and use a recyclable and reusable cleaning agent, so as to overcome the defects in the prior art.

The objective of the Invention may be achieved by using the following technical solutions:

A supercritical-state cleaning system comprises a cleaning chamber, a gas booster apparatus, a first heating apparatus, and a carbon dioxide supply apparatus. The cleaning chamber is separately connected to the first heating apparatus and the carbon dioxide supply apparatus. A vacuum pump set is connected to the cleaning chamber.

The carbon dioxide supply apparatus comprises a storage tank and a buffer tank connected to each other. The gas booster apparatus is disposed on a pipe between the buffer tank and the cleaning chamber. Carbon dioxide flows to the buffer tank from the storage tank, is boosted by the gas booster apparatus, and then enters the cleaning chamber.

Pipes in the system comprise: a fifth pipe with two ends respectively connected to the storage tank and the buffer tank, a third pipe with two ends respectively connected to the buffer tank and the cleaning chamber, a second pipe with two ends respectively connected to the cleaning chamber and the buffer tank, and a fourth pipe with two ends respectively connected to the buffer tank and the storage tank, the gas booster apparatus is separately connected to the third pipe and the fourth pipe, and a valve is disposed on each of the second pipe, the third pipe, the fourth pipe, and the fifth pipe, wherein before cleaning, the carbon dioxide is output from the storage tank and sequentially passes through the fifth pipe, the buffer tank, and the third pipe to enter the cleaning chamber, and after cleaning, the carbon dioxide is output from the cleaning chamber and sequentially passes through the second pipe, the buffer tank, and the fourth pipe to enter the storage tank.

The system further comprises a first pressure measurement apparatus connected to the cleaning chamber.

The system further comprises a second pressure measurement apparatus connected to the buffer tank.

The system further comprises a second heating apparatus and a third pressure measurement apparatus that are separately connected to the storage tank.

A dry ice addition port is disposed above the buffer tank.

A waste liquid recycle port is disposed at the bottom of the buffer tank.

A cleaning method using the supercritical-state cleaning system comprises the following steps:

S1. starting a vacuum pump set to vacuumize a cleaning chamber in which a target workpiece is placed;

S2. when a vacuum degree in the cleaning chamber satisfies a set requirement, turning off the vacuum pump set;

S3. making carbon dioxide in a storage tank pass through a buffer tank to enter the cleaning chamber, and starting a gas booster apparatus;

S4. when a pressure in the cleaning chamber reaches a set pressure, stopping the carbon dioxide from entering the cleaning chamber, turning off a pipe between the cleaning chamber and the outside, and starting a first heating apparatus to reach a set temperature in the cleaning chamber, so that the carbon dioxide enters a supercritical state; and S5. cleaning the target workpiece by using the carbon dioxide in a supercritical state.

A method for recycling carbon dioxide using the supercritical-state cleaning system comprises: making carbon dioxide in a cleaning chamber pass through a buffer tank to enter a storage tank, wherein a gas booster apparatus keeps the carbon dioxide in the buffer tank in a gaseous state.

Compared with the prior art, the Invention has the following advantages:

(1) A vacuum pump set is connected to a cleaning chamber. Air introduced when a workpiece enters the cleaning chamber is completely removed, so as to prevent mixing of $CO_2$ and air, thereby improving a cleaning effect, and ensuring that there is no residual cleaning agent on the surface of the workpiece.

(2) Carbon dioxide flows to a buffer tank from a storage tank. The buffer tank provides carbon dioxide buffer space, to make it easy to control air pressure change in the cleaning chamber.

(3) Before and after cleaning, the carbon dioxide separately flows through different pipes to implement the separation of cleaning and recycling, and the buffer tank is used as an intermediate node to achieve the effect of recycling carbon dioxide. Because a gas booster apparatus is separately connected to a third pipe and a fourth pipe, the carbon dioxide may be kept in different physical states before and after cleaning, so that a cleaning requirement and a storage requirement are separately satisfied, and the structure is simple. A valve is disposed on each of the four pipes, making it easy to control the pipes to be turned on or off without affecting each other.

(4) A pressure measurement apparatus is connected to the cleaning chamber, to ensure that the carbon dioxide in the cleaning chamber is in a critical state.

(5) A pressure measurement apparatus is connected to the buffer tank, to ensure that the carbon dioxide in the buffer tank is in a gaseous state, thereby facilitating the separation between waste liquid and the carbon dioxide.

(6) A pressure measurement apparatus and a second heating apparatus are connected to the storage tank, to keep the carbon dioxide in the storage tank in a liquid state, thereby saving storage space.

(7) A dry ice addition port is disposed above the buffer tank, so as to compensate for loss of carbon dioxide during use.

(8) A waste liquid recycle port is disposed at the bottom of the buffer tank, and the recycle port may be regularly opened to recycle quenching oil, to prevent an excessive amount of quenching oil in the buffer tank from polluting the carbon dioxide.

BRIEF DESCRIPTION OF THE DRAWINGS

The sole FIGURE is a schematic structural diagram of a cleaning system according to an embodiment of the Invention.

REFERENCE NUMERALS

1 is a vacuum pump set; 2 is a first pipe; 3 is a first pressure measurement apparatus; 4 is a cleaning chamber; 5 is a first heating apparatus; 6 is a target workpiece; 7 is a second pipe; 8 is a third pipe; 9 is a fourth pipe; 10 is a fifth pipe; 11 is a gas booster apparatus; 12 is a sixth valve; 13 is a seventh valve; 14 is a second pressure measurement apparatus; 15 is a buffer tank; 16 is a third pressure measurement apparatus; 17 is a storage tank; and 18 is a second heating apparatus.

DETAILED DESCRIPTION OF THE INVENTION

The Invention is described in detail below with reference to the accompanying drawings and specific embodiments. The embodiments are implemented based on the technical solutions of the Invention, and detailed implementations and specific operating processes are given, but the protection scope of the Invention is not limited to the following embodiments.

Embodiment

A supercritical-state cleaning system is provided. In the system, a heat treatment workpiece is cleaned by means of carbon dioxide in a supercritical state that can dissolve non-polar organic matter or organic matter having relatively low polarity. Inexpensive carbon dioxide (dry ice) is used as a cleaning medium, and the temperature and pressure are adjusted to switch the carbon dioxide among a liquid state, a gaseous state, and a supercritical state, so as to satisfy a cleaning requirement of the heat treatment workpiece.

$CO_2$ is in a supercritical state when the temperature is higher than 31.1° C. and the pressure is greater than 73 bar. The density of a supercritical fluid is greater than the density of a gas by hundreds of times, and has a value close to that of the density of a liquid. The viscosity of the supercritical fluid is less than that of a liquid by two orders of magnitude, and has a value close to that of the viscosity of gas. The diffusion coefficient of the supercritical fluid ranges between diffusion coefficients of a gas and a liquid, and is 1/100 as large as that of a gas but is greater than that of a liquid by hundreds of times. As can be seen here, the supercritical fluid has a density close to that of a liquid and therefore has a characteristic of dissolving a solute like a liquid. Moreover, the supercritical fluid has a characteristic of easy diffusion like a gas. The low viscosity and high diffuseness of the supercritical fluid facilitate the diffusion of a substance dissolved in the supercritical fluid and the permeation of the substance to a solid matrix. When a substance is in a supercritical state, the density of the substance changes significantly provided that the pressure and temperature change slightly, and the solubility of the substance changes accordingly. These characteristics are utilized in this patent to achieve the objective of this patent.

In this patent, $CO_2$ is switched from one state to another to achieve the objective of cleaning a workpiece. $CO_2$ is selected as a cleaning medium as $CO_2$ exists in nature and is safe, not flammable and explosive, non-toxic, and non-corrosive, and it is easy to implement a supercritical state of $CO_2$.

A vacuumization system requires to be mounted on cleaning equipment to completely remove air introduced when a workpiece enters the cleaning equipment, so as to prevent mixing of $CO_2$ and air to mitigate a cleaning effect. After vacuumization, carbon dioxide is added to a cleaning chamber, and a booster system is used to increase the pressure in the cleaning chamber to 73 bar or above. $CO_2$ in the cleaning chamber is then heated to keep the temperature above 31.1° C. In this case, $CO_2$ is in a supercritical state. $CO_2$ in a supercritical state can dissolve non-polar organic matter or organic matter having relatively low polarity, and therefore can dissolve quenching oil attached on the surface of the workpiece.

After cleaning ends, $CO_2$ in the cleaning chamber is discharged to a specific buffer tank. The pressure in the buffer tank is controlled to keep $CO_2$ in a gaseous state. In this way, quenching oil dissolved when $CO_2$ is in a supercritical state can be released. Eventually, gaseous $CO_2$ is transferred to a storage tank through the booster system for a next cycle of work.

No other gas or liquid is mixed in the entire cleaning process, so that perfect recycling and reuse are implemented, energy resources are saved, and an optimal cleaning effect can be achieved, thereby bringing economic benefits to users.

As shown in the sole FIGURE, the system comprises a cleaning chamber 4, a gas booster apparatus 11, a first heating apparatus 5, and a carbon dioxide supply apparatus. The cleaning chamber 4 is separately connected to the first heating apparatus 5 and the carbon dioxide supply apparatus. A vacuum pump set 1 is connected to the cleaning chamber 4. The vacuum pump set 1 and the cleaning chamber 4 are connected through a first pipe 2. A first valve 21 is disposed on the first pipe 2.

The carbon dioxide supply apparatus comprises a storage tank 17 and a buffer tank 15 connected to each other. The gas booster apparatus 11 is disposed on a pipe between the buffer tank 15 and the cleaning chamber 4. Carbon dioxide flows to the buffer tank 15 from the storage tank 17, is boosted by the gas booster apparatus 11, and then enters the cleaning chamber 4.

Pipes in the system comprise: a fifth pipe 10 with two ends respectively connected to the storage tank 17 and the buffer tank 15, a third pipe 8 with two ends respectively connected to the buffer tank 15 and the cleaning chamber 4, a second pipe 7 with two ends respectively connected to the cleaning chamber 4 and the buffer tank 15, and a fourth pipe 9 with two ends respectively connected to the buffer tank 15 and the storage tank 17. The gas booster apparatus 11 is connected to the third pipe 8 and the fourth pipe 9. The gas booster apparatus 11 is disposed at the middle part of the buffer tank 15, so as to ensure that no waste liquid impurity is contained in the third pipe 8 and the fourth pipe 9. A valve is disposed on each of the second pipe 7, the third pipe 8, the fourth pipe 9, and the fifth pipe 10.

Before cleaning, the carbon dioxide is output from the storage tank 17 and sequentially passes through the fifth pipe 10, the buffer tank 15, and the third pipe 8 to enter the cleaning chamber 4. After cleaning, the carbon dioxide is output from the cleaning chamber 4 and sequentially passes through the second pipe 7, the buffer tank 15, and the fourth pipe 9 to enter the storage tank 17.

A first pressure measurement apparatus 3 is connected to the cleaning chamber 4. A second pressure measurement apparatus 14 is connected to the buffer tank 14. A second heating apparatus 18 and a third pressure measurement apparatus 16 are connected to the storage tank 17.

A dry ice addition port 13 is disposed above the buffer tank 15, and a waste liquid recycle port 12 is disposed at the bottom of the buffer tank 15.

A cleaning method using the cleaning system in this embodiment comprises the following steps:

S1. starting the vacuum pump set 1 to vacuumize the cleaning chamber 4 in which a target workpiece 6 is placed;

S2. when a vacuum degree in the cleaning chamber 4 satisfies a set requirement, turning off the vacuum pump set 1;

S3. making carbon dioxide in the storage tank 17 pass through the buffer tank 15 to enter the cleaning chamber 4, and starting the gas booster apparatus 11;

S4. when a pressure in the cleaning chamber 4 reaches a set pressure, stopping the carbon dioxide from entering the cleaning chamber 4, turning off the pipe between the cleaning chamber 4 and the outside, and starting the first heating apparatus 5 to reach a set temperature in the cleaning chamber 4, so that the carbon dioxide enters a supercritical state; and S5. cleaning the target workpiece 6 by using the carbon dioxide in a supercritical state.

A method for recycling carbon dioxide using the supercritical-state cleaning system comprises: making the carbon dioxide in the cleaning chamber 4 pass through the buffer tank 15 to enter the storage tank 17, wherein the gas booster apparatus 11 keeps the carbon dioxide in the buffer tank 15 in a gaseous state.

The vacuum pump set 1 is connected to the cleaning chamber 4 through the first valve 2.

A specific operation process is as follows:

First, the target workpiece 6 is placed in the cleaning chamber 4. The valve on the first pipe 2 and the vacuum pump set 1 are then started. Vacuumization processing is performed on the cleaning chamber 4 to eliminate air introduced by the target workpiece 6, to prevent $CO_2$ added in a next step from being polluted and ensure the cleanliness of $CO_2$ in the entire cleaning system.

When the first pressure measurement apparatus 3 detects that a vacuum degree in the cleaning chamber 4 satisfies a set requirement, the valve on the first pipe 2 and the vacuum pump set 1 are turned off. The valve on the fifth pipe 10, the valve on the third pipe 8, and the gas booster apparatus 11 are then turned on to transfer $CO_2$ in the storage tank 17 to the cleaning chamber 4 via the buffer tank 15, to clean the target workpiece 6.

When the first pressure measurement apparatus 3 detects that the pressure in the cleaning chamber 4 reaches a set pressure (greater than 73 bar), transfer of $CO_2$ is stopped. The first heating apparatus 5 is then started to control the temperature in the cleaning chamber 4 to reach a set temperature (greater than 31.1° C.). In this case, it is ensured that $CO_2$ in the cleaning chamber 4 is in a supercritical state, thereby satisfying a requirement of cleaning the target workpiece 6.

After cleaning is completed, the valve on the second pipe 7, the valve on the fourth pipe 9, and the gas booster apparatus 11 are turned on. $CO_2$ in the cleaning chamber 4 is transferred to the storage tank 17 via the buffer tank 15, to complete the cleaning process.

To save space, the second heating apparatus 18 and the third pressure measurement apparatus 16 are controlled to keep $CO_2$ in a liquid state in the storage tank 17.

The second pressure measurement apparatus 14 is used to control $CO_2$ in the buffer tank 15 to be in a gaseous state. In this way, $CO_2$ switches from a supercritical state in the cleaning chamber 4 to a gaseous state in the buffer tank 15. Quenching oil that is dissolved when $CO_2$ is in a supercritical state is released to the buffer tank 15, and the sixth valve 12 is regularly opened to recycle the quenching oil. After the equipment operates a long time, to compensate for loss of $CO_2$ during use, the seventh valve 13 may be used to complete a supplement.

The invention claimed is:

1. A supercritical-state cleaning system, comprising a cleaning chamber, a gas booster apparatus, a first heating apparatus, and a carbon dioxide supply apparatus, wherein the cleaning chamber is separately connected to the gas booster apparatus, the first heating apparatus, and the carbon dioxide supply apparatus, and a vacuum pump set is connected to the cleaning chamber, wherein the carbon dioxide supply apparatus comprises a storage tank and a buffer tank connected to each other, the gas booster apparatus is disposed on a pipe between the buffer tank and the cleaning chamber, and carbon dioxide flows to the buffer tank from the storage tank, is boosted by the gas booster apparatus, and then enters the cleaning chamber, wherein pipes in the system comprise: a fifth pipe with two ends respectively connected to the storage tank and the buffer tank, a third pipe with two ends respectively connected to the buffer tank and the cleaning chamber, a second pipe with two ends respectively connected to the cleaning chamber and the buffer tank, and a fourth pipe with two ends respectively connected to the buffer tank and the storage tank, the gas booster apparatus is separately connected to the third pipe and the fourth pipe, and a valve is disposed on each of the second pipe, the third pipe, the fourth pipe, and the fifth pipe, wherein before cleaning, the carbon dioxide is output from the storage tank and sequentially passes through the fifth pipe, the buffer tank, and the third pipe to enter the cleaning chamber, and after cleaning, the carbon dioxide is output from the cleaning chamber and sequentially passes through the second pipe, the buffer tank, and the fourth pipe to enter the storage tank.

2. The supercritical-state cleaning system according to claim 1, wherein the system further comprises a first pressure measurement apparatus connected to the cleaning chamber.

3. The supercritical-state cleaning system according to claim 1, wherein the system further comprises a second pressure measurement apparatus connected to the buffer tank.

4. The supercritical-state cleaning system according to claim 1, further comprising a second heating apparatus and a third pressure measurement apparatus that are separately connected to the storage tank.

5. The supercritical-state cleaning system according to claim 1, wherein a dry ice addition port is disposed above the buffer tank.

6. The supercritical-state cleaning system according to claim 1, wherein a waste liquid recycle port is disposed at the bottom of the buffer tank.

* * * * *